US006019665A

United States Patent [19]

Lee et al.

[11] Patent Number: 6,019,665

[45] Date of Patent: Feb. 1, 2000

[54] CONTROLLED RETENTION OF SLURRY IN CHEMICAL MECHANICAL POLISHING

[75] Inventors: Michael G. Lee, San Jose; Solomon I. Beilin, San Carlos, both of Calif.

[73] Assignee: Fujitsu Limited, Japan

[21] Appl. No.: 09/070,587

[22] Filed: Apr. 30, 1998

[51] Int. Cl.[7] ..... B24B 1/00

[52] U.S. Cl. ..... 451/36; 451/59; 451/288

[58] Field of Search ..... 451/36, 59, 60, 451/259, 285–289, 446, 550, 290

[56] References Cited

U.S. PATENT DOCUMENTS

| | | | |
|---|---|---|---|
| 4,346,824 | 8/1982 | Miller et al. | 222/504 |
| 4,349,296 | 9/1982 | Langeman | 405/99 |
| 4,435,247 | 3/1984 | Basi et al. | 156/636 |
| 4,679,359 | 7/1987 | Suzuki | 51/321 |
| 4,726,709 | 2/1988 | Labelle | 405/103 |
| 4,771,982 | 9/1988 | Bodine et al. | 251/129.1 |
| 4,832,527 | 5/1989 | Bachmann | 405/105 |
| 4,869,779 | 9/1989 | Acheson | 156/636 |
| 4,910,155 | 3/1990 | Cote et al. | 437/8 |
| 4,940,507 | 7/1990 | Harbarger | 156/636 |
| 5,040,336 | 8/1991 | Ahern | 51/7 |
| 5,157,876 | 10/1992 | Medellin | 451/36 |
| 5,171,102 | 12/1992 | De Wit | 405/101 |
| 5,230,163 | 7/1993 | Lease | 34/57 A |
| 5,232,875 | 8/1993 | Tuttle et al. | 437/225 |
| 5,399,234 | 3/1995 | Yu et al. | 156/636 |
| 5,584,898 | 12/1996 | Fulton | 451/36 X |
| 5,667,424 | 9/1997 | Pan | 451/286 X |
| 5,681,216 | 10/1997 | Jennings | 451/550 X |
| 5,868,610 | 2/1999 | Nishio | 451/286 X |

FOREIGN PATENT DOCUMENTS 62-99073(A) 10/1985 Japan .

*Primary Examiner*—David A. Scherbel
*Assistant Examiner*—Anthony Ojini
*Attorney, Agent, or Firm*—Coudert Brothers

[57] ABSTRACT

A weir with locks is used to encompass a platen used for chemical-mechanical polishing. The weir retains slurry that would otherwise be flung from a rotating platen because of centrifugal force. However, the locks permit some slurry to leave the platen, which enables the polishing process to include desirable flows of fresh slurry through the polishing pad to replenish polishing components and to flush out deleterious waste products. Additionally, the effective orifice size of the locks may be made a function of platen rotation rate. Polishing processes are possible in which the depth of the polishing slurry on the platen is a function of platen rotation rate.

21 Claims, 7 Drawing Sheets

CONTROLLED RETENTION OF SLURRY IN CHEMICAL MECHANICAL POLISHING

FIELD OF THE INVENTION

This invention relates generally to integrated circuit manufacturing, and more specifically to processes for the chemical mechanical polishing of semiconductor wafers and package mounts.

BACKGROUND OF THE INVENTION

Chemical mechanical polishing (CMP) processes are commonly used in the manufacture of integrated circuits to planarize wafer surfaces. As shown in the prior art cross-sectional schematic drawing of FIG. 1, typical CMP systems include a semi-porous polishing pad 17 mounted on the upper surface of a planar platen 16. The polishing pad is wetted with a chemically reactive, abrasive slurry from a supply tube 18. Commonly, the platen is relatively large in comparison to a wafer 12 to be planarized and is rotated during the polishing process. Wafer 12 is held by means of a wafer carrier 11, which typically is capable of transverse movement 15 and also rotational movement about a shaft 14. The rotational and transverse movement of the wafer with respect to the polishing pad facilitates uniform CMP etch rates across the wafer surface.

There are many variables that affect the ability of a specific CMP process to planarize a wafer surface. These include the pressure between polishing pad 17 and wafer 12, the hardness of polishing pad 17, the slurry composition, and the relative motion between the platen and the wafer (e.g., platen and wafer rotation rates). One important variable of a CMP process is the rate at which fresh polishing slurry is supplied. During a CMP process, chemical components of the slurry are continuously consumed by the polishing process. Waste by products of the polishing process are also generated. The nature of the deleterious waste products will depend upon the particular polishing process, but may include reacted chemical by-products of the polishing process, degraded polishing pad components, or particulates from the abrasive component of the slurry. The chemical and mechanical aspects of the polishing process may change if the active components of the polishing slurry become depleted or if deleterious waste products build up. A constant flow of fresh slurry to the platen is thus desirable to replenish the active components of the slurry and to flush out deleterious waste products.

Fresh slurry is typically supplied to wafer 12 on a continuous basis, such as by dripping a continuous stream of slurry from supply tube 18 onto a portion of pad 17. In addition to refreshing the reacted or depleted slurry, slurry must also be supplied because centrifugal force tends to fling slurry off of the edge of the platen as the platen rotates. As shown in the prior art cross-sectional drawing of FIG. 2, polishing pad 17 rotates at an angular velocity $\omega_p$. The equivalent linear speed (L) of the polishing pad at a radius, r, from a central axis 0, is $\omega_p$ r. Also, as shown in FIG. 2 the wafer 12 may also be rotated about its axis at an angular velocity $\omega_w$.

At high platen rotation rates, a substantial flow of fresh slurry onto the polishing pad 17 from the supply tube 18 may be required to compensate for slurry flung off from the edges of the platen. Also, at high platen rotation rates, substantially larger quantities of slurry are flung from the platen and at a higher velocity. This increases the difficulty of containing slurry chemicals and particulates proximate to the polishing system. Additionally, the increased slurry consumption increases the cost of the polishing process. Another problem associated with high platen rotation rates is that the polishing pad may become unevenly wetted. The edge regions of the pad will tend to become substantially wetter than the center most pad regions because of the effect of centrifugal force. This is highly undesirable as it may result in non-uniform polishing across the polishing pad.

One attempted solution to these problems is flood polishing. In flood polishing schemes, dams are erected around the circumference of the platen to hold in the polishing slurry. Flooding the platen with a deep pool of slurry facilitates wetting the entire pad. The dam acts to retain the slurry from being flung off of the platen such that typically no additional slurry is dripped onto the platen during the polishing process. However, such flood polishing schemes have several limitations. First, in common flood polishing schemes, there is no simple technique to continuously refresh consumed slurry components and to flush out deleterious waste products. The level of polishing slurry is typically chosen to flood the entire platen with approximately a quarter inch (6.35 mm) of slurry in order to provide a reservoir of polishing components to supply all polishing needs. Additionally, the slurry reservoir must be large enough that waste products do not build up to deleterious levels. Second, in conventional flood polishing methods, there is no simple way to continuously adjust the slurry depth as a function of platen rotation rate. This is undesirable because fixing the slurry depth at one initial level will tend to limit the variations in platen rotation rate that are feasible during the polishing process. For example, because flood polishing uses a deep pool of slurry, it may suffer from undesirable hydroplaning at high platen rotation rates. In the most general case, the mechanical energy imparted by the polishing pad to the wafer will depend both on platen rotation rate and upon the slurry depth. Fixing the slurry depth at a constant level thus limits the ability of a process engineer to control the mechanical component of a chemical mechanical polishing process.

What is desired is an apparatus and method to increase control of the flow of polishing slurry on a rotating platen used in a chemical mechanical polishing process.

SUMMARY OF THE INVENTION

The present invention generally comprises a weir with locks that encompasses the circumference of a platen used for a chemical-mechanical polishing process. The weir is a physical barrier to prevent polishing slurry from leaving the platen. It thus helps to retain polishing slurry that would otherwise be flung from the rotating platen by centrifugal force. However, in order to allow control of slurry depth and refreshing of the slurry, slurry may leave the platen through the locks. In an equilibrium situation, the average slurry depth across the platen will reach a level in which the flow of fresh slurry to the platen is balanced by the flow of slurry out from the locks. The present invention permits desirable replenishing of fresh slurry to the platen and control of slurry depth while reducing slurry waste.

In the present invention, the gates of the locks may be mechanically or electronically controlled to adjust the effective orifice size of the locks as a function of platen rotation rate. In one embodiment, the effective orifice size of the locks changes with rotation rate due to centrifugal force which causes the swinging open or closure of the pendulum gates. In another embodiment, the locks have spring gates in which centrifugal forces swing the spring gates open or closed. In yet another embodiment, the locks have inertial gates designed to slide across the surface of the weir as the angular velocity of the platen increases, altering the gate position to adjust the orifice size of the lock. In another embodiment, the gates are electronically actuated using motors or solenoids.

The present invention is also directed to a method of chemical mechanical polishing. In one embodiment of this polishing method, the slurry depth is selected for a particular platen rotation rate by adjusting the effective orifice size of the lock. In another embodiment of this polishing method, the slurry depth on the platen is selected to be a function of platen rotation rate.

DETAILED DESCRIPTION OF THE INVENTION

The inventors have realized that the ideal polishing system should conserve slurry while also providing desirable flows of fresh slurry to continuously replenish the polishing components of the slurry and to flush out deleterious waste by-products of the polishing process. The inventors have also realized that it would be advantageous to have a polishing system in which the slurry level on the platen can be controlled. This has advantages in terms of the quality of the polishing process. For example, in some polishing processes there may be insufficient slurry replenishment if the slurry level on the platen is too shallow. Control over the slurry level on the platen may also offer other benefits as well. For example, if the slurry level is too deep, it may flood the polisher and exacerbate the problems of equipment maintenance. Additionally, the inventors have realized that the slurry level on the platen is an additional factor that affects the mechanical aspects of the polishing process. A practical method to control the slurry level on the platen would permit new polishing processes in which the slurry level on the platen was adjusted during the process, unlike conventional polishing processes in which the slurry depth is primarily limited to either an extremely thin film or to flood polishing conditions.

The present invention generally comprises a weir with locks. As is commonly defined in semiconductor manufacturing, a weir is a dam-like structure which has walls to limit the flow of a liquid. As is commonly defined in civil engineering and mechanical engineering, a lock is a passageway with adjustable gates. Gates control the flow of fluid through the passageway, typically by altering the effective cross-sectional size of the passageway or opening. The present invention can thus also be generally described as comprising a dam-like structure that has orifices (holes) in the walls of the dam and which also has gate-like structures that can be adjusted to control the flow rate of liquid through the orifices.

Figure 1:
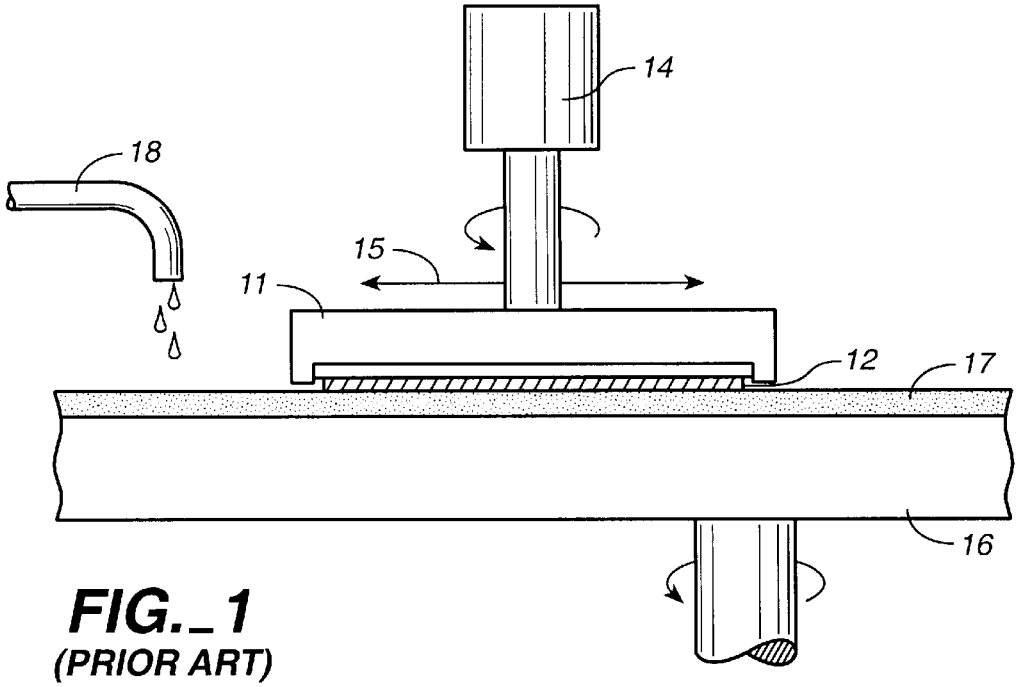
FIG. 1 (PRIOR ART)
FIG. 1 shows a prior art cross-sectional schematic diagram of a conventional chemical-mechanical polishing system.
Figure 2:
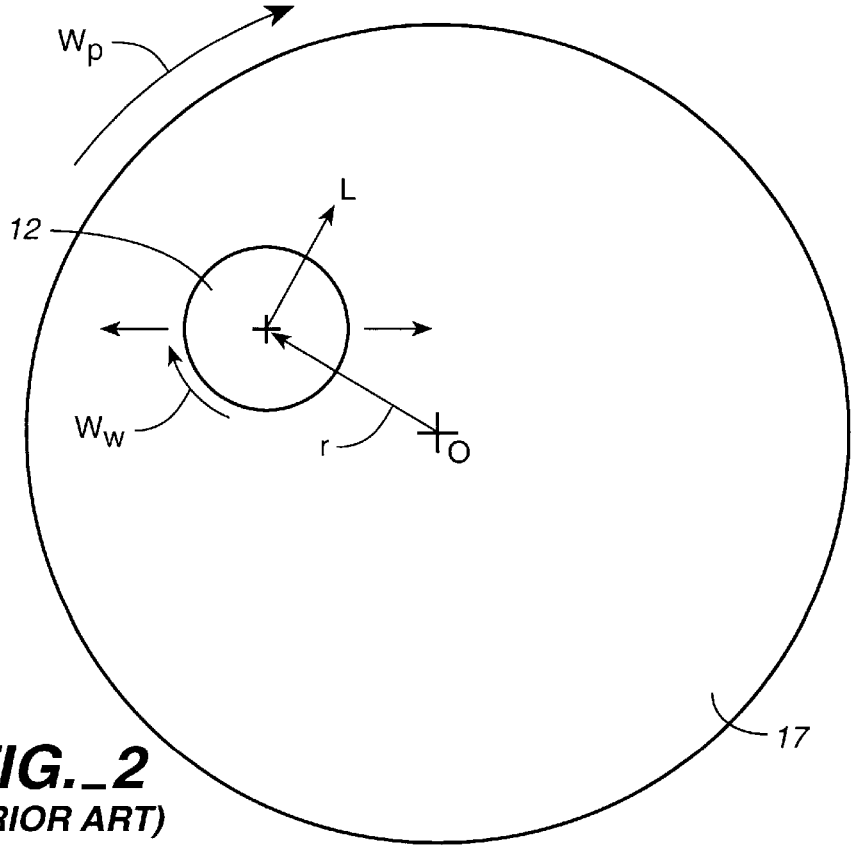
FIG. 2 (PRIOR ART)
FIG. 2 shows a prior art schematic top view of a chemical mechanical polishing system showing the relative motion of the platen and the substrate.
Figure 3:
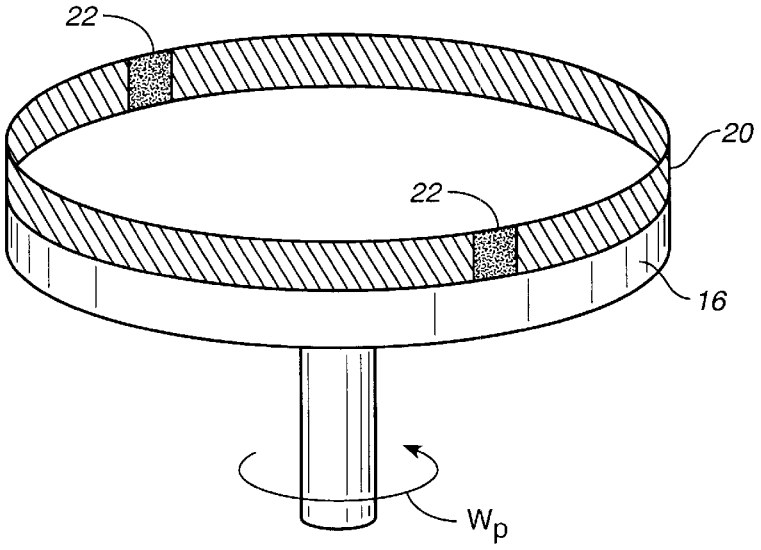
FIG. 3 shows a perspective view of a weir surrounding a platen in accordance with the present invention.
Figure 4:
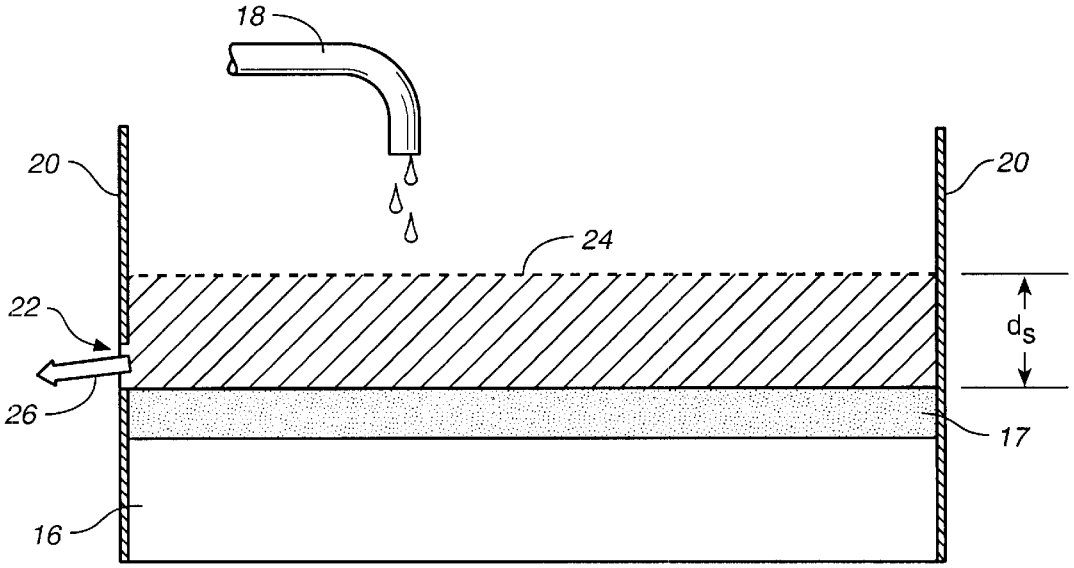
FIG. 4 is a cross-sectional view of a weir constructed according to the present invention in which the flow of fresh slurry to the platen is balanced by an outflow of slurry through the lock.

As shown in FIG. 3, the present invention comprises a weir 20 dimensioned to encompass the circumference of the top surface of a chemical mechanical polishing platen 16. The weir 20 also includes at least one lock 22. The flow rate of slurry from the locks can be estimated by those skilled in the art of fluid mechanics by using well known equations to account for flows caused by gravity and centrifugal force. Generally, the flow of slurry out from the locks will be a function of the effective cross-sectional orifice size of the locks, the height of the orifices above the platen, the platen rotation rate, the depth of slurry on the platen (if the slurry level rises above the polishing pad), and other variables, such as slurry viscosity. As shown in the schematic not-to-scale cross-sectional diagram of FIG. 4, at equilibrium the slurry 24 will reach an average depth, $d_S$, above the polishing pad 17 of platen 16 when the flow of fresh slurry to platen 16 from slurry supply 18 is balanced by the flow of outgoing slurry 26 from locks 22. However, if the orifice size of the locks 22 is comparatively large, the polishing slurry will not rise above the surface of platen 16 ($d_S$=0), but at equilibrium there will be an average pad wetness characterized by the saturation limit of porous polishing pad 17 to absorb slurry.

The weir may be constructed from any material resistant to attack from common chemical mechanical polishing slurry components. Examples of suitable materials include anodized aluminum and polypropylene, which are not attacked by the chemical mechanical polishing slurries that are commonly used to planarize wafers. Preferably, the weir should be designed to facilitate the removal and attachment of polishing pads 17 on the upper surface of the platen 16. The weir may be rigidly attached to the platen. However, those skilled in the art are familiar with techniques to demountably mount such a weir on the edge of a platen to form a substantially watertight seal.

Figure 5:
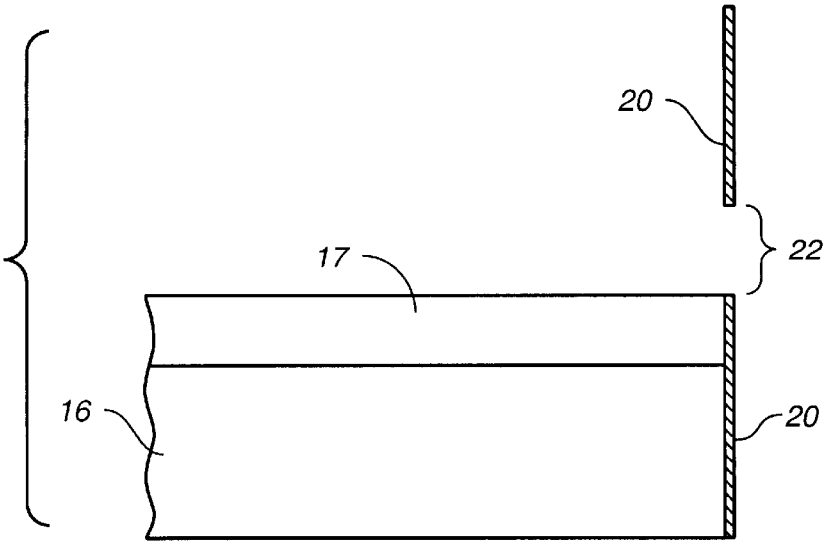
FIG. 5 is a cross-sectional side view of a weir showing a lock comprised of a hole in the dam wall of the weir.

As shown in FIG. 5, in one embodiment of the present invention, locks 22 are comprised of generally rectangular-shaped orifices in weir 20. The desired cross-sectional size of the orifices will depend, as described below in more detail, upon fluid flow considerations. Those skilled in the art are familiar with techniques to rapidly determine an appropriate cross-sectional size of the orifices based upon experimental studies or upon theoretical models to calculate slurry flow rates through an orifice as a function of cross-sectional area and other variables.

Figure 6:
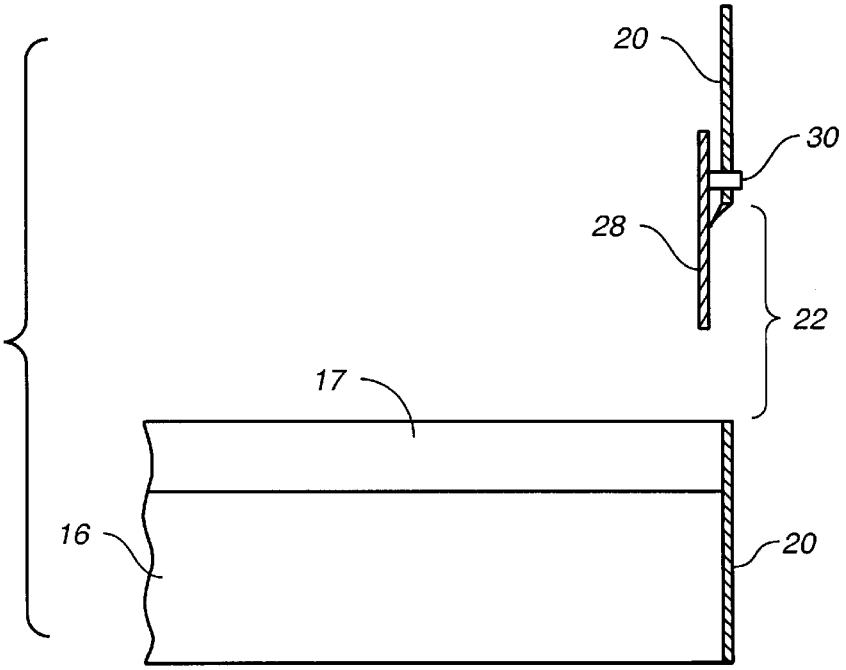
FIG. 6 is a cross-sectional side view of a weir in which the lock has a gate that can be externally adjusted.

As shown in FIG. 6, another embodiment of the present invention includes gates 28 that may be positioned to cover part or all of the orifice of lock 22, resulting in a reduced effective orifice size of lock 22. While a generally plate-shaped gate 28 is shown in FIG. 6, other obstructing elements (e.g., a cork-shaped plug or an iris configuration) that act to block or otherwise obstruct the flow of slurry through the orifice of lock 22 could also be used. The gates could be rigidly attached. However, preferably the position of the gates 28 is adjustable. For example, external screws 30 can be used to adjust gates 28 over the orifices of locks 22. Other conventional locking means, such as pins or clasps, may be used instead of external screws 30 to secure the gate into position.

The inventors have also realized that it is desirable to have the capability to alter the average slurry depth as the platen rotation rate is varied during the polishing process. There are four distinctly different polishing regimes. These regimes correspond to a polishing pad that is only partially saturated with slurry; a polishing pad that is substantially saturated with slurry; a polishing pad covered with a shallow film of slurry; and a polishing pad covered with a comparatively deep layer of slurry. In each or these distinct regimes, the polishing process may also depend upon the average pad wetness or the slurry depth for non-saturated and saturated polishing pads, respectively. The mechanical aspects of the polishing process may be substantially different for each of these regimes. For example, at a fixed platen rotation rate, a polishing process using a deep layer of slurry may produce a different polishing result than a polishing process using a thin film of slurry if the mechanical component of the polishing process is altered because of the change in slurry depth. It is thus desirable to have a practical means to alter the slurry depth.

In the present invention, the locks 22 have a mode of operation in which gates 28 automatically adjust the effective orifice size of locks 22 as a function of platen rotation rate. If there is a constant flow of fresh slurry from the supply 18, then a new equilibrium depth of slurry 24 will result as a consequence of gates 28 adjusting as a function of platen rotation. For example, if the effective orifice size of the locks decreases with increasing rotation rate, the depth of slurry 24 will increase with increasing platen rotation rate. Conversely, if the effective orifice size of locks 22 increases with platen rotation rate, the depth of slurry 24 will decrease with increased rotation rate.

Figure 7A:
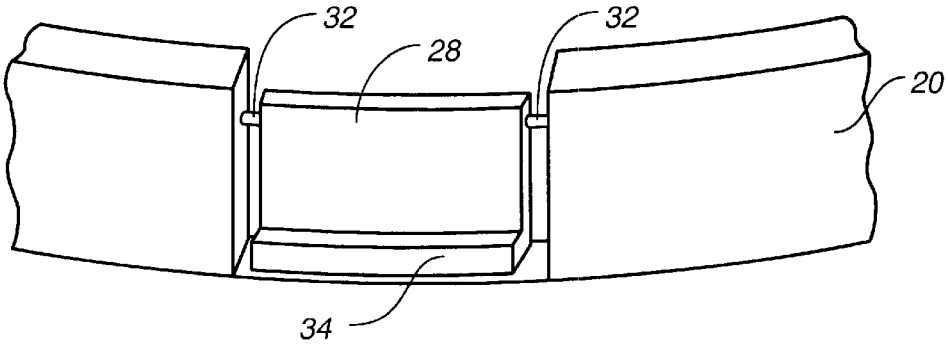
FIG. 7A is a front view of a weir showing a pendulum gate with its center of gravity selected such that the pendulum gate swings open in response to increased centrifugal force.
Figure 7B:
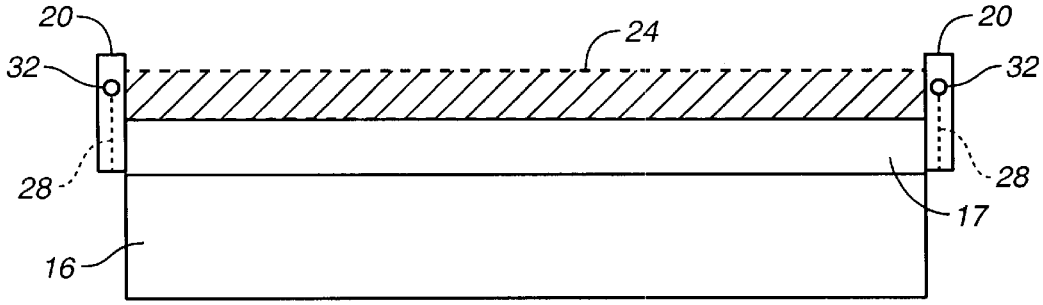
FIG. 7B is a cross-sectional side view of the weir of FIG. 7A for comparatively low platen rotation rates in which the gates of the locks are substantially closed.
Figure 7C:
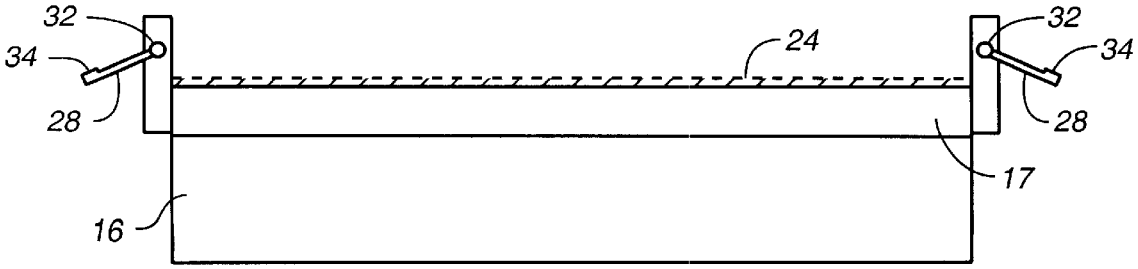
FIG. 7C is a cross-sectional side view of the weir of FIG. 7A for comparatively high platen rotation rates in which the gates of the locks are substantially open.

A preferred embodiment of the present invention comprises pendulum gates responsive to centrifugal force. In the present invention, a pendulum gate is a generally plate-like structure that is free to pivot around pivot points defining an axis of rotation for the gate. However, the center of gravity of a pendulum gate can be selected such that centrifugal force acts to either tilt the gate open or closed. As is well known to those skilled in the art of mechanical engineering, centrifugal force adds a force component which is directed radially outward. Those skilled in the art of mechanical engineering are familiar with techniques to calculate the forces acting to tilt a pendulum-like structure when both the forces of gravity and centrifugal forces are present. A plate-like gate that is free to tilt about its pivot point will rotate until the forces of gravity and centrifugal force balance one another. As shown in the front view of FIG. 7A, a pendulum gate may comprise a gate 28 free to rotate on two pivot points 32 situated generally at the upper edge of the gate 28. An additional weight, 34 may be added proximate to the bottom edge of the gate 28 such that gravity acts to force the gate closed. As shown in the schematic side view of FIG. 7B, at comparatively low platen rotation rates, the gate remains substantially closed. However, at comparatively high platen rotation rates, centrifugal force becomes comparable to gravitational forces and the gate 28 tilts open, as shown in FIG. 7C. As previously observed, for a constant flow rate of fresh slurry from supply 18, the slurry depth will increase until at equilibrium the flow of fresh slurry form supply 18 is balanced by out-going slurry 26. FIGS. 7B and 7C also illustrate the effect the gate response has on slurry depth 24 if a constant flow rate of fresh slurry is supplied to the platen. If, as shown in FIG. 7B, at a particular platen rotation rate the gate 28 is substantially closed, the equilibrium depth of slurry 24 will be comparatively high. If, as shown in FIG. 7C, the gate 28 is substantially open at a particular platen rotation rate, the equilibrium depth of slurry 24 will be comparatively low.

Figure 8A:
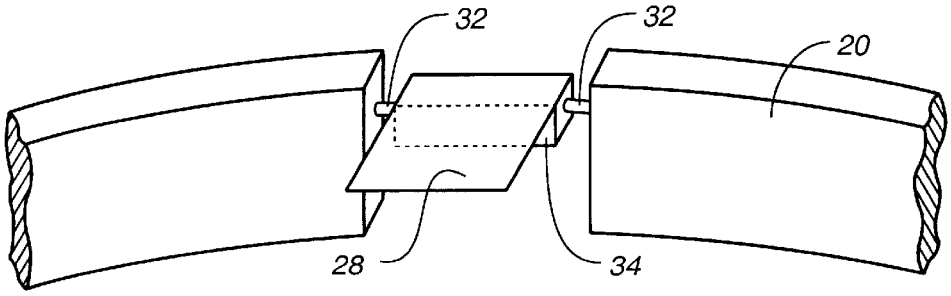
FIG. 8A is a front view of a weir looking in from the center of the platen showing a pendulum gate with its center of gravity selected such that the pendulum gate swings closed in response to increased centrifugal force.
Figure 8B:
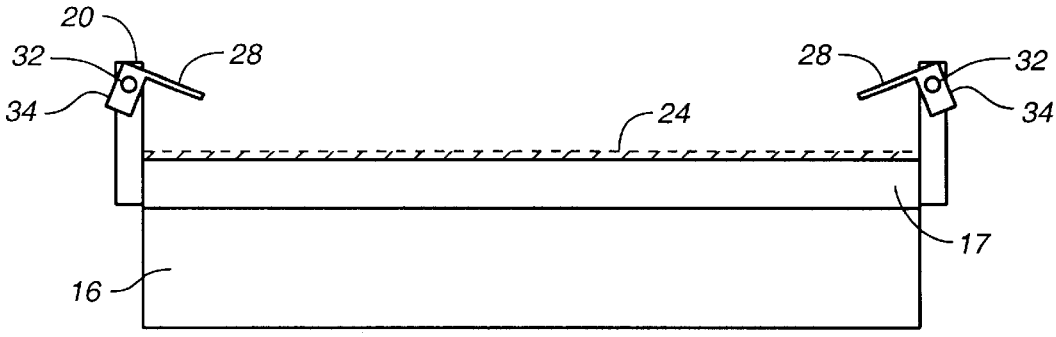
FIG. 8B is a cross-sectional side view of the weir of FIG. 8A for comparatively low platen rotation rates in which the gates of the locks are substantially open.
Figure 8C:
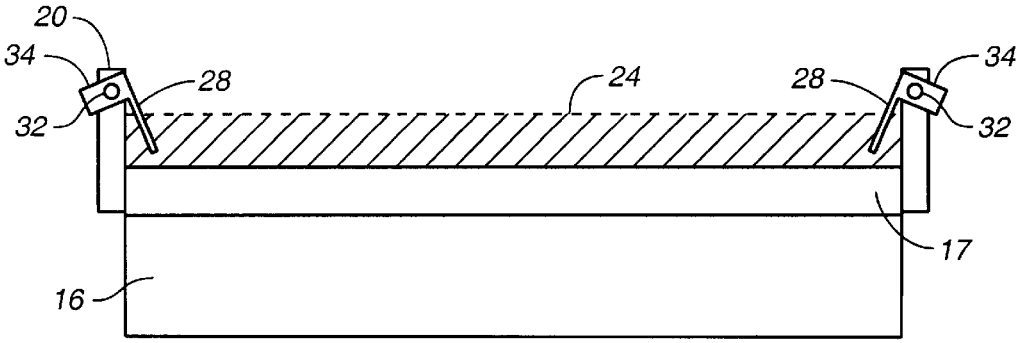
FIG. 8C is a cross-sectional side view of the weir of FIG. 8A for comparatively high platen rotation rates in which the gates of the locks are substantially closed.

A pendulum gate may also be designed such that the gate 28 closes in response to increased centrifugal force. As shown in the front view of FIG. 8A looking in from the center of the platen 16, additional weights 34 may be added near the top of the gate 28 above the pivot points 32 such that force of gravity acts to tilt the gate 28 upwards toward the center of the platen 16. At low platen rotation rates, as shown in the cross-sectional side view of FIG. 8B, the gate 28 will remain substantially open. Consequently, the slurry depth 24 will be comparatively low. However, for high platen rotation rates, as shown in the cross-sectional side view of FIG. 8C, the gate 28 will tilt closed. Consequently, the slurry depth 24 will increase until at equilibrium the flow of fresh slurry from supply 18 is balanced by out-going slurry 26.

Variations on the pendulum gate structure shown in FIGS. 7 and 8 are possible. In particular, variations on the location of the pivot points 32 and the center of mass of gate 28 are possible. Those skilled in the art of mechanical engineering are familiar with techniques to achieve a similar function to that described by changing the pivot location, number of pivot points, and center of mass of the gate.

Figure 9:
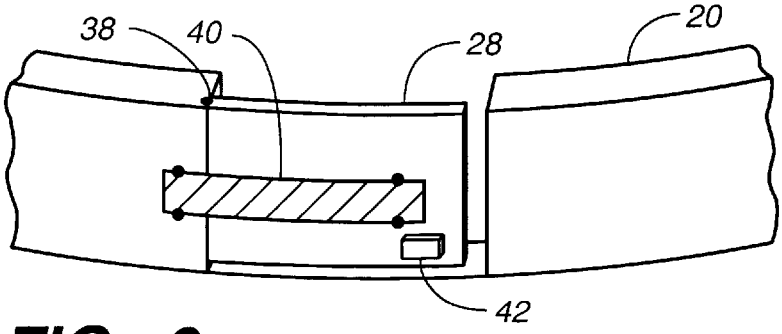
FIG. 9 is a front view of a weir with a spring gate in which a leaf spring provides a restoring force that keeps the gate substantially closed except at comparatively high platen rotation rates.
Figure 10A:
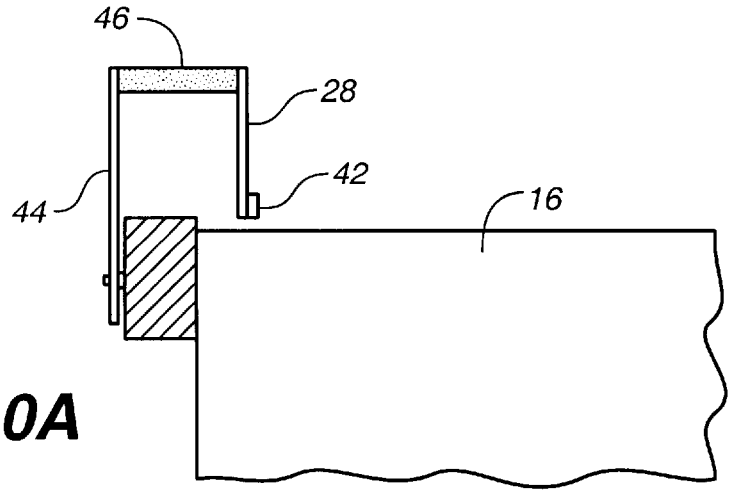
FIG. 10A is a cross-sectional side view of a gate in which a leaf spring provides a restoring force that maintains the gate substantially closed at comparatively low platen rotation rates.
Figure 10B:
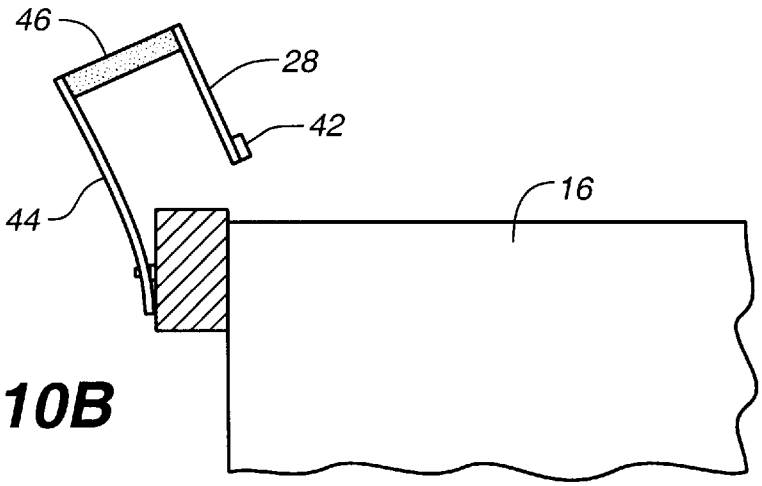
FIG. 10B is a cross-sectional side view of the gate of FIG. 10A for comparatively high platen rotation rates.

A second embodiment of the present invention comprises spring gates responsive to centrifugal force. In the present invention, a spring gate is a movable gate responsive to centrifugal force that has springs or a spring-like structure coupled between the weir 20 and gates 28 to maintain gates 28 in either a substantially open or closed position at low platen rotation rates. At high platen rotation rates, gates 28 will experience increased centrifugal force such that the gate will alter its position until the restoring spring force balances the centrifugal force on the gate. One embodiment of a spring gate is shown in the front view of FIG. 9. A generally door-shaped spring gate 28 is attached to hinge points 38 on the weir 20 with a leaf spring 40 coupling the weir 20 and the spring gate 28. Additional weights 42 may be added to the spring gate 28. At low platen rotation rates, the leaf spring 40 will maintain the spring gate 28 in a substantially closed position. However, at high platen rotation rates, the spring gate 28 may swing substantially open. Many variations on the design of FIG. 9 are possible. For example, instead of a hinge point 38, pivots could be used. Another embodiment of a spring gate is shown in the cross-sectional side view of FIG. 10A. A leaf spring 44 is used to provide restoring forces to a spring gate 28 through a connecting member 46. The connecting member may be weighted or additional weights 42 added to the gate 28. As shown in the cross-sectional side view of FIG. 10B, at high platen rotation rates the leaf spring will bend from the centrifugal forces imparted by the connecting member 46, deflecting the spring gate 28 upwards.

A third embodiment of the present invention comprises inertial gates responsive to the angular momentum, or velocity, of the weir. In terms of common cylindrical coordinates, at any instant of time, an inertial gate located on the edge of the platen has radial, axial, and azimuthal components of momentum. Momentum is conserved unless the gate is acted upon by external forces. If the gate is rigidly attached to the weir at one or more points, the weir will transmit the centripetal forces necessary for the gate to rotate at the same rate and in phase with the weir. If, however, the gate is free to move azimuthally around the weir surface, the weir will not be able to transmit azimuthal forces directly. However, additional springs could be used to couple such a sliding gate to the weir. Moreover, the inertial gates will move relative to the weir until the spring provides sufficient force to continuously alter the momentum of the inertial gate to keep it moving at the same rotation rate as the weir.

Figure 11:
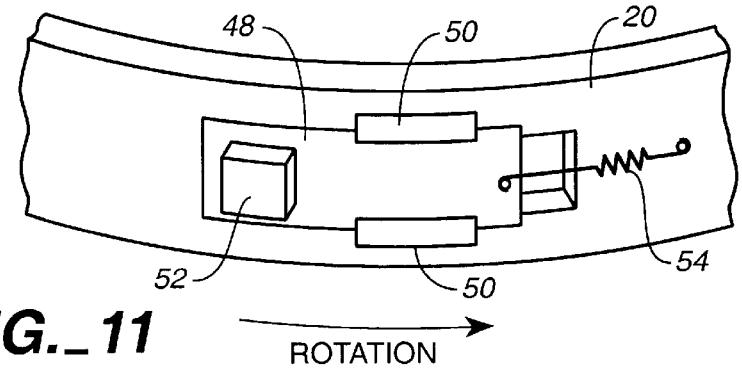
FIG. 11 is a front view of a gate that slides open as the rotational velocity of the weir increases.

One embodiment of an inertial gate is shown in the side view of FIG. 11. The inertial gate 48 is free to slide transversely (which in cylindrical coordinates would be the azimuthal direction) in lateral guides 50 around the circumference of the weir 20. Additional weights 52 may be added to the inertial gate 48. An azimuthal spring 54 located on the surface of the weir 20 is used to couple the inertial gate 48 to the weir 20. The azimuthal spring 54 provides the forces necessary for the angular velocity of the inertial gate 48 to match that of the weir. As the rotation rate of the platen increases, the azimuthal spring 54 must extend in order to provide increased azimuthal forces on the inertial gate 48. At high platen rotation rates the inertial gate 48 will rotate relative to the weir 20 until it is substantially open. However, by changing the relative location of the orifice of the lock and the gate, the inertial gate 48 could also slide relative to the weir 20 to substantially close a lock at high platen rotation rates.

Figure 12:
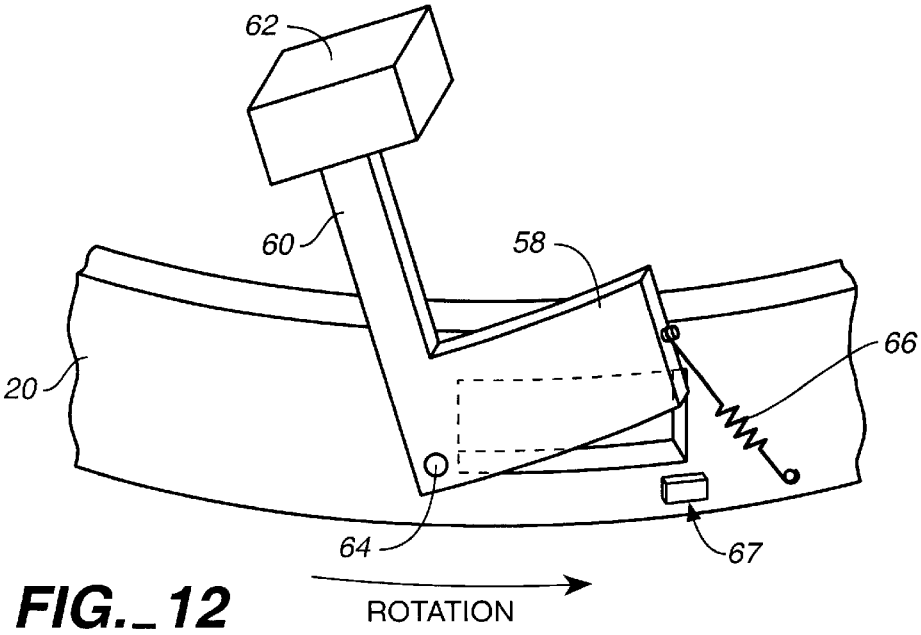
FIG. 12 is a front view of a gate that tilts open as the rotational velocity of the weir increases.

Another embodiment of an inertial gate structure is shown in FIG. 12. The generally L-shaped gate 56 has a base leg 58 dimensioned to cover the lock and a weighted leg 60 that couples a balancing weight 62 to the L-shaped gate 56. The L-shaped gate is capable of rotating about a radial pivot point 64 located proximate to the intersection of the base leg 58 and the weighted leg 60. An additional spring 66 couples the base leg 58 to the weir 20. An additional stop plate 67 can be incorporated to provide a surface for the base leg 58 to rest on when the lock is closed. When the platen is at rest, the primary forces on the L-shaped gate 56 are the force of gravity on the weighted leg 60 and the spring force associated with the spring 66. The L-shaped gate 56 will tilt about the radial pivot point 64 until the forces are in equilibrium. However, when the platen 16 rotates, the radial pivot point 64 presents the case of a moving pivot point. The azimuthal motion of the pivot point 64 will tend to cause it to advance azimuthally ahead of the balancing weight 62. The L-shaped gate 56 will tilt about its pivot point until the spring 66 is extended such that the L-shaped gate 56 comes into dynamic equilibrium.

Figure 13:
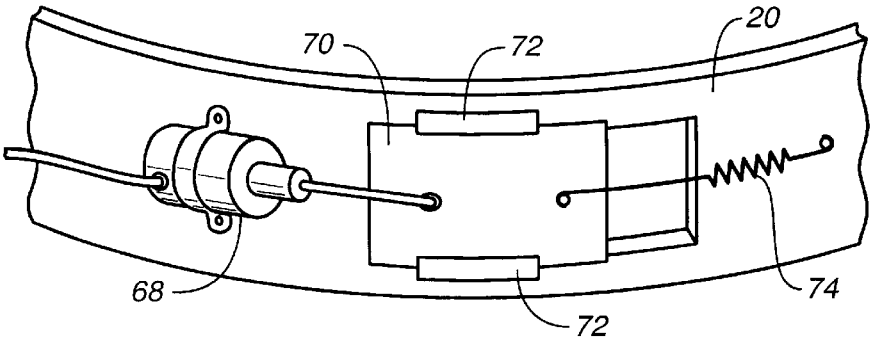
FIG. 13 is a front view of a gate that is opened by a solenoid.

A fourth embodiment of the present invention comprises an electromechanically actuated gate. In the present invention, an electromechanical gate is a gate which is a generally plate-like structure that is free to move transversely in at least one direction across the surface of the weir but whose position relative to the lock can be electronically controlled by an electronic actuator. Many means, such as motors, could be used to control the gate position. However, electronic solenoids are comparatively cheap and reliable. As shown in FIG. 13, one embodiment of an electromechanical gate comprises an electronic solenoid 68 coupled to a gate 70 free to slide in transverse guides 72. Additional springs 74 may be used to provide restoring forces to the gate when the solenoid is shut off. Additional electronic circuit means, known to those skilled in the art of circuit design, may be used to measure the platen rotation rate and to send control signals to the solenoid. One or more such electromechanical gates may be switched fully open or closed at a selected platen rotation rate. The current to the solenoid may be calibrated to provide a controlled force to adjust the position of the gate. Additionally, the solenoids may be switched in a pulsed mode to achieve a time-averaged effective aperture size. For example, pulsing the solenoids with pulses having a 50% duty cycle would achieve an effective orifice size approximately half the lock size.

Combinations of the above embodiments are also possible. For example, pendulum gates may have additional springs added to alter their performance. A combination of different weights and springs could be used to adjust the rotation rate response of a gate. Additionally, pins or clasps could be added to lock individual gates into a fixed position for a particular process or to provide stops to gate movement.

A weir with a plurality of locks could be designed to achieve a complex response to platen rotation rate. Those skilled in the art of mechanical engineering are familiar with techniques to design simple mechanical systems to achieve a complex bandpass-type response. For example, consider a weir with three locks 22. A first lock 22 could have a gate 28 designed to close at low platen rotation rates. A second lock 22 could have a gate 28 designed to open at high platen rotation rates. A third lock 22 could have a constant orifice size to keep the slurry level 26 below some maximum depth 24 regardless of rotation rate.

In addition to conserving slurry, the present invention provides additional control over the polishing process. Conventional polishing methods do not provide a practical means to vary the slurry level over a wide range. For example, platen rotation rates of 30 rpm, 50 rpm, and 100 rpm are commonly used in polishing processes. However, conventional polishing methods do not provide a practical means to vary the average slurry depth in reproducible increments in the range of 1 mm to 5 mm.

Using the present invention, a semiconductor manufacturing engineer can adjust the gate response and flow of fresh slurry to the platen at a particular platen rotation rate to adjust the average slurry depth. The mechanical energy imparted by the polishing pad to the wafer will depend both on platen rotation rate and upon the slurry depth. At a particular platen rotation rate there may be an optimal slurry depth to achieve a desired polishing result (e.g., local planarization, uniformity, or surface damage). For example, one skilled in the art could use the present invention to rapidly evaluate the polishing characteristics of a polishing process performed at various platen rotation rates (e.g., 30 rpm, 50 rpm, and 100 rpm) and at several slurry depths (e.g., 1 mm, 2 mm and 5 mm) for each rotation rate.

The present invention also permits a polishing process to be designed in which both the platen rotation rate and the average slurry depth are simultaneously varied during the polishing process. In general, the history of the platen rotation rate may comprise a complex platen rotation rate profile. As described above, in the present invention the rotation rate response of the gate may be altered in several ways, such as by changing the mass distribution of a gate. The flow rate of fresh slurry to the platen can also be selected by the fabrication engineer within a considerable range. By selecting the flow rate of slurry to the platen and adjusting the rotation-rate response of the locks, the average depth of the slurry on the platen may be made rotation rate dependent. This permits a method of polishing in which both the platen rotation rate and the average slurry depth are varied during the polishing process. For example, the platen rotation profile might consist of a first polishing step conducted at a comparatively high rotation rate, $\omega_1$, of 100 RPM with a corresponding first slurry depth, $d_1$, of 1 mm followed by a second polishing step at a lower rotation rate, $\omega_2$, of 30 RPM with a corresponding second slurry depth, $d_2$, of 5 mm. Generally, the present invention permits a method of polishing in which the platen rotation rate and the average slurry depth (or pad wetness) can be varied over wide ranges during the polishing process in order to advance different polishing objectives (e.g., local planarization, uniformity, or low surface damage) at different stages of the polishing process. For example, the platen rotation rate and slurry depth may be selected in a first step of polishing to enhance the mechanical component of the polishing process to achieve rapid local planarization while the platen rotation rate and slurry depth may be selected in a second step of polishing to reduce the mechanical component of the polishing process to achieve high wafer uniformity and low surface damage. Other objectives, such as reducing the consumption of slurry, may also be considerations in designing a particular polishing process.

While the present invention has been described with reference to the specific embodiments and elements disclosed, it is understood that other, equivalent embodiments of the invention are possible, and that the practice of the invention is not intended to be limited solely to those embodiments disclosed in this application.

What is claimed is:

1. A polishing system comprising:

a platen having a top surface on which a structure may be polished;

a barrier wall to a flow of polishing slurry disposed on the circumferential edge of the platen;

a passageway disposed in the barrier wall proximate to the top surface of the platen, the passageway having an effective cross-sectional area for the flow of fluid through the passageway; and a slurry source for disposing polishing slurry on said top surface of the platen.

2. The polishing system of claim 1 further comprising an obstructing element positioned proximate to the passageway, the position capable of being adjusted to reduce the effective cross-sectional area of the passageway.

3. The polishing system of claim 2 wherein the plate-shaped element alters the effective cross-sectional area of the passageway as a function of platen rotation rate.

4. A polishing system comprising:

a platen having a top surface on which a structure may be polished;

a slurry source for disposing polishing slurry on said top surface;

a weir disposed around a circumferential edge of the platen and providing a barrier to a flow of slurry outward from the circumferential edge of the platen; and a lock disposed in the weir proximate to the surface of the platen, the lock having a gate to control an effective orifice size of the lock.

5. The polishing system of claim 4 wherein the lock comprises a hole in a dam wall of the weir.

6. The polishing system of claim 5 further comprising rotation means to rotate the platen.

7. The polishing system of claim 6 wherein the gate adjusts the effective orifice size of the lock as a function of the rotation rate of the platen.

8. The polishing system of claim 7 wherein the gate adjusts the effective orifice size of the lock in response to centrifugal force.

9. The polishing system of claim 8 wherein the gate is a pendulum gate comprised of a generally plate-shaped gate supported by pivots, the pivots generally located proximate to the sides of the lock.

10. The polishing system of claim 9 wherein the center of mass of the pendulum gate is selected such that gate tilts open in response to centrifugal force.

11. The polishing system of claim 9 wherein the center of mass of the pendulum gate is selected such that the gate tilts closed in response to centrifugal force.

12. The polishing system of claim 9 further comprising a spring coupling said gate to the weir.

13. The system of claim 8 wherein the gate is a spring gate comprised of a generally plate-shaped gate coupled to the weir by leaf springs dimensioned such that the leaf springs supply a restoring force to the outward radial movement of the gate.

14. The system of claim 13 wherein the spring gate is also supported by at least one pivot generally located proximate to the lock.

15. The system of claim 8 wherein the gate is an inertial gate that alters the size of the orifice of the lock in response to the angular velocity of the platen.

16. The system of claim 15 wherein the inertial gate comprises a generally plate-shaped gate capable of sliding transversely along the surface of the weir, said gate being coupled to the weir by at least one spring.

17. The system of claim 16 wherein the inertial gate is dimensioned to slide along the surface of the weir in transverse guides that are oriented generally parallel to the surface of the platen.

18. The system of claim 17 wherein additional weights are added to the gate to increase its response to the angular velocity of the platen.

19. The system of claim 15 wherein the gate is supported on the surface of the weir by a pivot generally located proximate to the orifice of the lock.

20. The system of claim 4 wherein the gate position is electromechanically controlled.

21. The system of claim 20 wherein the position of the gate is adjusted by an electrical solenoid.

* * * * *